US006170406B1

(12) United States Patent
Klein et al.

(10) Patent No.: US 6,170,406 B1
(45) Date of Patent: Jan. 9, 2001

(54) RECESSED MONITOR TABLE

(75) Inventors: Mark P. Klein, Chicago; John W. Poremba, Elmhurst; Salvatore S. Graziano, Western Springs; Mark Stenftenagel, Elmhurst, all of IL (US)

(73) Assignee: Bretford Manufacturing, Inc., Franklin Park, IL (US)

( * ) Notice: Under 35 U.S.C. 154(b), the term of this patent shall be extended for 0 days.

(21) Appl. No.: 09/384,075

(22) Filed: Aug. 26, 1999

(51) Int. Cl.[7] ..... A47B 37/00
(52) U.S. Cl. ..... 108/50.01
(58) Field of Search ..... 108/50.01, 50.02, 108/1; 312/223.3, 223.6, 195; 248/918

(56) References Cited

U.S. PATENT DOCUMENTS

| | | | | |
|---|---|---|---|---|
| 4,828,342 | | 5/1989 | Stefan . | |
| 5,041,770 | | 8/1991 | Seiler et al. . | |
| 5,071,204 | | 12/1991 | Price et al. . | |
| 5,377,951 | | 1/1995 | Johnson et al. . | |
| 5,480,224 | * | 1/1996 | Ugalde | 312/223.3 X |
| 5,544,594 | * | 8/1996 | Schairbaum | 108/50.01 |
| 5,572,935 | * | 11/1996 | Schairbaum | 312/223.3 X |
| 5,651,594 | | 7/1997 | Lechman . | |
| 5,655,823 | * | 8/1997 | Schairbaum | 312/223.3 X |
| 5,680,820 | | 10/1997 | Randolph . | |
| 5,694,861 | * | 12/1997 | Laukamm-Josten | 108/50.01 |
| 5,699,225 | * | 12/1997 | Yavitz et al. | 108/50.01 X |
| 5,758,934 | | 6/1998 | Flutka et al. . | |
| 5,791,259 | * | 8/1998 | Mansfield et al. | 108/50.01 X |
| 5,980,004 | * | 11/1999 | Shoenfeld | 312/223.3 |
| 6,042,203 | * | 3/2000 | Bogucki | 312/223.3 |

FOREIGN PATENT DOCUMENTS

| | | | | |
|---|---|---|---|---|
| 4100675 | * | 7/1992 | (DE) | 312/223.3 |

* cited by examiner

*Primary Examiner*—Jose V. Chen
(74) *Attorney, Agent, or Firm*—Welsh & Katz, Ltd.

(57) ABSTRACT

An improved recessed computer monitor table that is capable of quickly and easily providing for height and angle adjustment of a computer monitor. The table comprises a top that has an opening adapted to receive the computer monitor and a support base attached to the top. Also, one or more recess side panels are adapted to mount to the top lower portion. Further, a rod adjuster assembly and one or more adjuster panels are provided. The one or more adjuster panels are adapted to adjustably mount to the one or more recess side panels and have one or more slots disposed on the one or more adjuster panels. The one or more slots are also adapted to receive the rod adjuster assembly. At least one recess top pan is provided that is pivotably mounted to the one or more adjuster panels at a first end and movably mounted to the one or more adjuster panels at a second end having the at least one slot.

20 Claims, 3 Drawing Sheets

RECESSED MONITOR TABLE

FIELD OF THE INVENTION

The present invention relates to recessed monitor tables, and more particularly to recessed monitor tables that provide for easy adjustment of the angle and height of a computer monitor.

BACKGROUND OF THE INVENTION

Recessed monitor tables of various types are known in the art. Such devices are typically used with personal computers having a monitor and a keyboard attached. Personal computers are increasingly being used in business, education and home environments. Typically, computer workstations have the computer monitor and keyboard located on top of a desk or counter. The computer monitor is normally tall in height and prevents the user from looking over the monitor while the user is in a seated position. Frequently, the user is not able to adjust the monitor to a position where it is comfortably viewed while in use and where the user has an unobstructed view over the monitor. The inability to adjust the computer monitor viewing angle and/or height position often reduces the efficiency of the computer user. Prior art monitor tables do not allow for the height and angle of the monitor relative to the surface it rests on to be adjusted easily by the user. This forces the user to adapt to the position of the monitor rather than allowing the user to easily adjust the monitor to the user's specific needs. Therefore, the computer user must experience visual and/or physical strain during the operation of the computer to look over or at the monitor. One of the problems with a computer monitor which cannot be adjusted to a user's physical requirements is neck strain and/or back pain resulting from always holding the neck and/or back in an uncomfortable position to view the monitor.

The prior art has attempted to provide recessed monitor tables; however, they have some inherent disadvantages. One of the disadvantages is that the monitor tables are designed so that the computer monitors are not height or angle adjustable with respect to the table top. Ergonomic principles dictate that a computer monitor should be adjustable to the requirements of each individual user in order to maximize the efficiency of each individual user, rather than force each user to adapt to a specific monitor arrangement. Some other monitor tables that are in the prior art do provide for height or angle adjustment of the monitor, but the adjustments are difficult for the computer user to make.

The present invention overcomes these and other problems inherent in existing recessed monitor tables. The present invention provides a recessed monitor table that has a recess assembly that is easily adjustable and allows the user to have a clear line of sight over the computer monitor. This feature is especially useful in a computer training classroom environment. For example, the entire computer monitor may be easily lowered (or raised) so that the user can see the instructor at the front of the training room. Further, the entire computer monitor may be easily tilted to different angles to provide the most comfortable monitor viewing angle for the computer user. Also, the present invention provides a cord management system for data and power lines. The power and data lines are not interfered with when the monitor is repositioned either by height adjustment or angle adjustment.

OBJECTS OF THE INVENTION

The principal object of the present invention is to provide a novel recessed monitor table that supports a monitor which can be angle and height adjustable with respect to the table top.

Another object of the present invention is to provide a novel recessed monitor table that is ergonomically designed.

Still another object of the present invention is to provide novel recessed monitor tables that can be arranged side-by-side in a row.

A further object of the present invention is to provide a recessed monitor table that provides for easy adjustment of the angle and height of the computer monitor with respect to the table top.

A further object of the present invention is to provide a novel recessed computer monitor table that neatly stores data and power lines.

A further object of the present invention is to provide a novel recessed computer monitor table that supports a variety of different monitor sizes and shapes.

A further object of the present invention is to provide a novel recessed monitor table which is simple in design, inexpensive to manufacture, easy to assemble and is durable and rugged in structure.

Still further objects and advantages will become apparent from a consideration of the ensuing description and drawings of the invention.

SUMMARY OF THE INVENTION

These and other objects are achieved by a recessed monitor table of the present invention. In one form of the invention, a recess monitor assembly is provided, that, when attached to a table top having a cut-out large enough for a computer monitor to fit through, is capable of supporting a computer monitor. Further, the recess assembly may easily provide for height and angle adjustment of the computer monitor to provide the user with the specific monitor viewing position required. Alternate embodiments of the present invention may provide a central processing unit holder, cord and wire storage locations, and power assembly.

DETAILED DESCRIPTION

Figure 1:
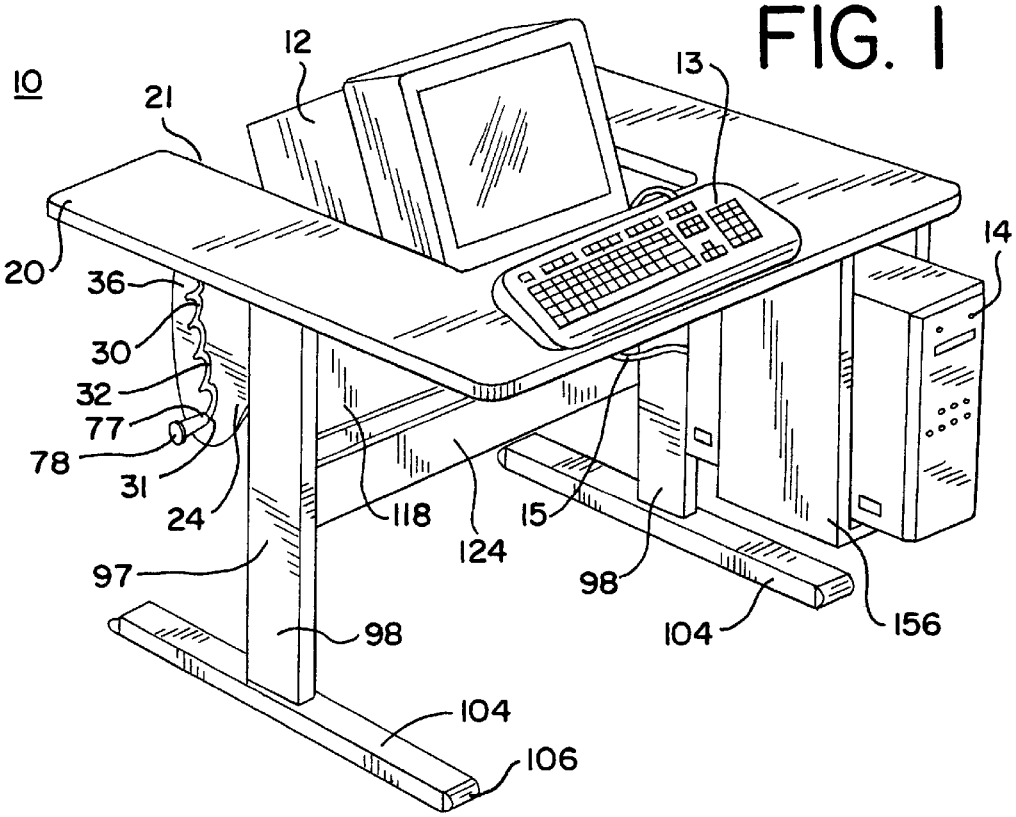
FIG. 1 is a front perspective view of one embodiment of the recessed monitor table of the present invention showing the computer monitor in a recessed position.
Figure 2:
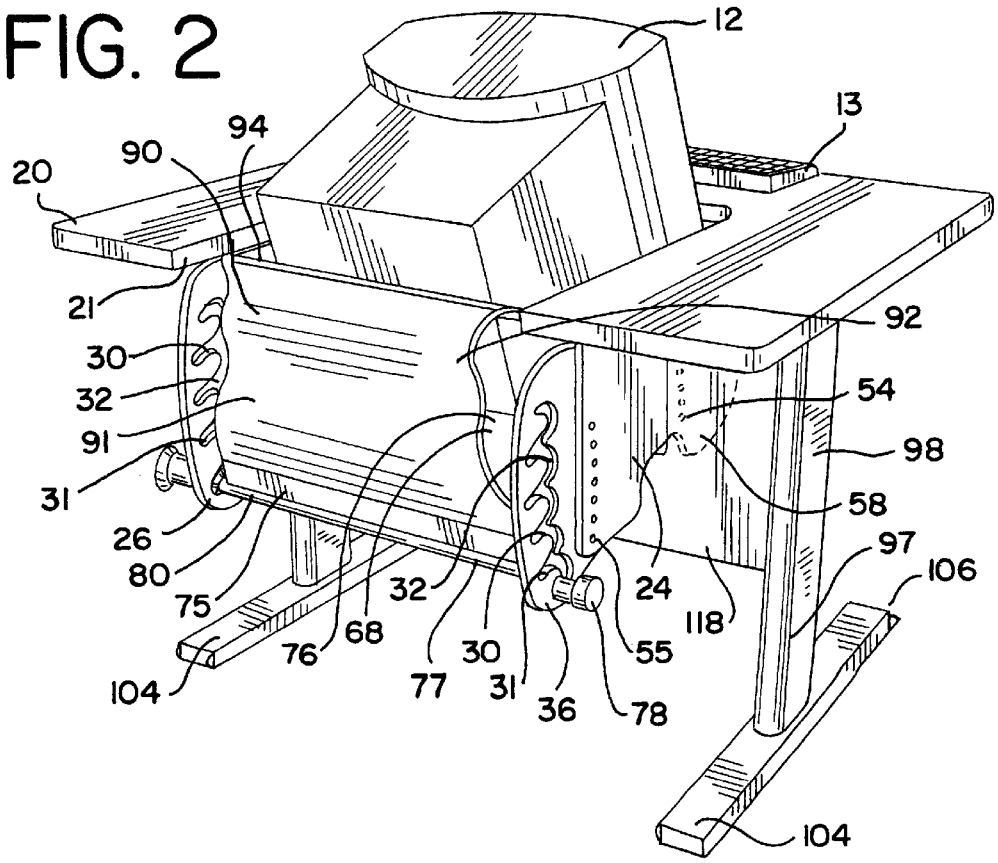
FIG. 2 is a rear perspective view of an alternate embodiment of the recessed monitor table of FIG. 1.
Figure 3:
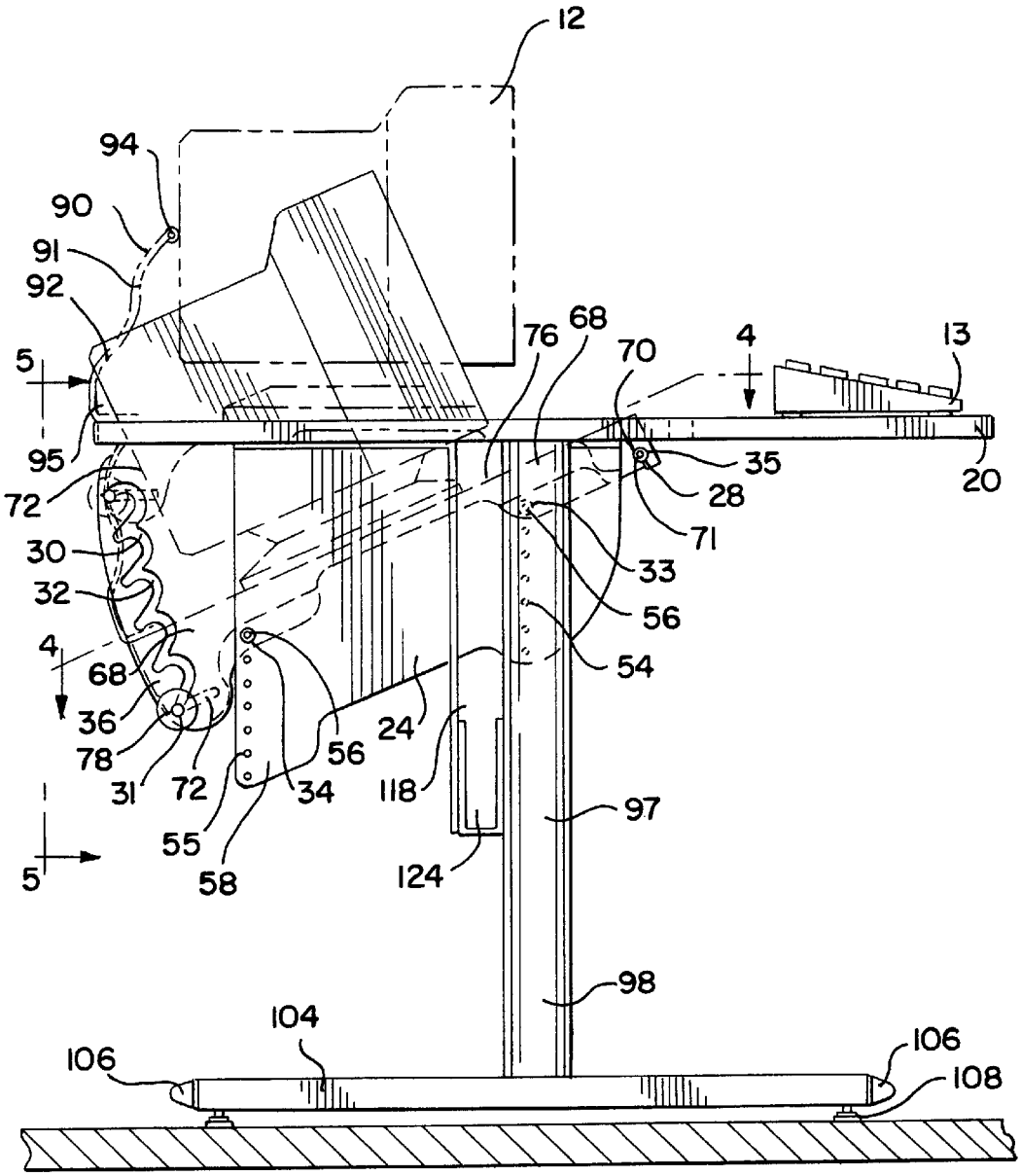
FIG. 3 is a left side view of an alternate embodiment of the recessed monitor table of FIG. 1 showing the computer monitor in a fully upright position (in dashed lines) and in a recessed position.
Figure 5:
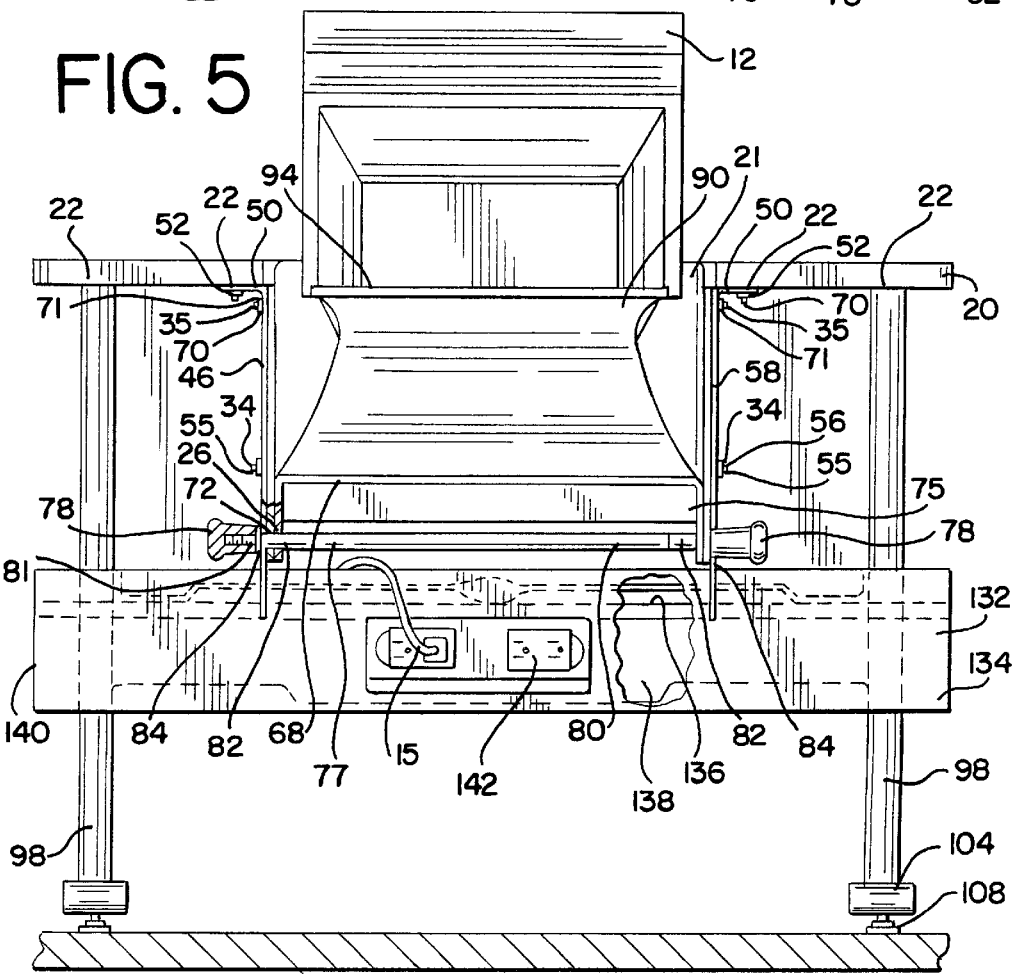
FIG. 5 is a rear view of an alternate embodiment of the recessed monitor table taken along line 5—5 of FIG. 3.

FIG. 1 is a front perspective view of one embodiment of the recessed monitor table 10 constructed in accordance with the present invention. In FIG. 1, the recessed monitor table comprises a top 20, a recess assembly 24, a back support 90 (as best shown in FIG. 2), a base assembly 97, a modesty panel assembly 118, a power assembly 132 (as best shown in FIG. 5) and a central processing unit (CPU) holder 156. As best shown in FIGS. 2 and 3, the recess assembly 24 may comprise adjuster panels 26 and 36, recess side panels 46 and 58, a recess top pan 68, rod adjuster assembly 77 and a back support 90. Also shown in FIG. 1, in place on the table 10, are a computer monitor 12, keyboard 13 and CPU 14.

The top 20, for example, may be 36" deep and may have a U-shaped cut-out 21 that may be 20.5 inches long×20.5 inches wide. The U-shaped cut-out 21 may be designed to adapt and hold monitors 12 ranging in size from 15 to 21 inches or may be modified to hold larger or smaller sized monitors 12. The top 20 may contain, for example, 10.75" of surface space on each of the left and right side of the cut-out. The top 20 may be fabricated from 1" thick particle board with high pressure laminate and 3 mm PVC edges. The top 20 may also be made of any other material that will provide for proper operation of the recessed monitor table 10. Further, the top 20 may contain mounting holes 22 to attach the recess assembly 24 and the base assembly 97 to the top 20. Also, connectors such as ganging clips, for example model numbers PDQclip and PGCclip as supplied by Bretford Manufacturing located in Franklin Park, Ill., may be used to connect adjoining tables 10. The aforementioned table measurements may also be any measurements or combination of measurements that will provide for proper operation of the recessed monitor table 10.

Figure 4:
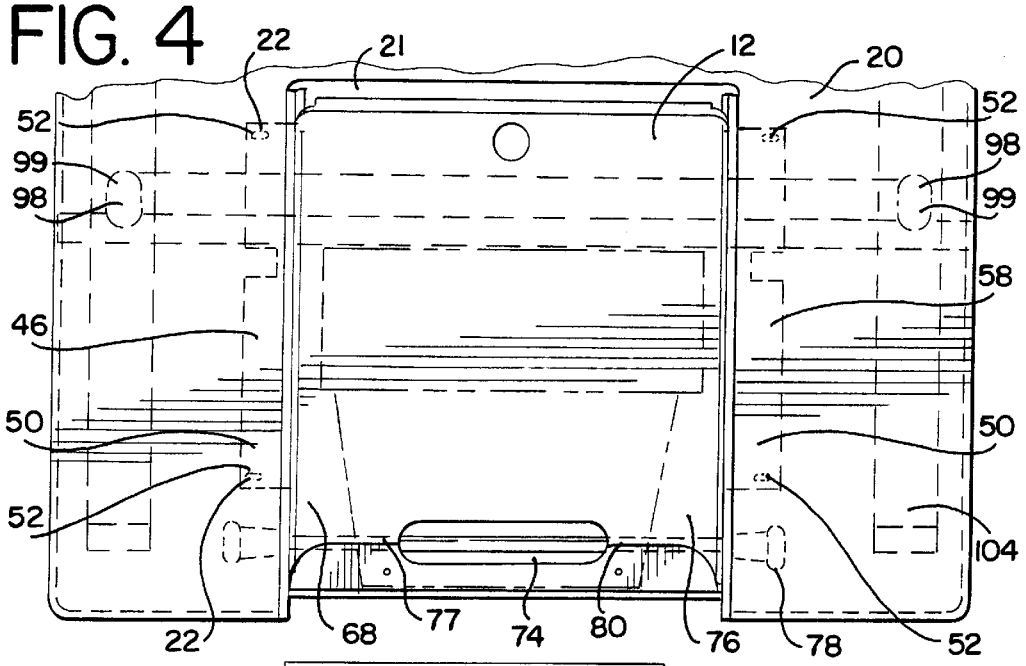
FIG. 4 is a top view of an alternate embodiment of the recessed monitor table taken along line 4—4 of FIG. 3 with the front portion of the top cut away.

As best shown in FIGS. 3, 4 and 5, the recess side panels 46, 58 may comprise height adjuster holes 54 and 55, flanges 50, mounting holes 52 and fasteners 56. FIGS. 4 and 5 show one embodiment of the table 10 where the recess side panels 46, 58 are mounted to the top 20 at mounting holes 52 with fasteners 56. In this mounting configuration, side panels 46, 58 may be substantially perpendicular to top 20. As shown in FIG. 3, height adjuster holes 54, 55 may be located at opposite ends of side panels 46, 58. In one embodiment, holes 54, 55 may be disposed in a substantially straight line on the panels 46, 58. Further, holes 54, 55 may be substantially equally spaced apart from each adjacent hole 54 or 55. The recess side panels 46, 58 may be constructed of metal, plastic, wood or any other type of material that will provide for proper operation of the table 10.

As best shown in FIGS. 2 and 3, adjuster panels 26 and 36 may comprise one or more pivot holes 28, one or more inverted J-shaped slots 30 having one or more slot bottoms 31 and one or more height adjuster holes 33, 34. As shown in FIG. 3, in one embodiment, height adjuster holes 33, 34 may be disposed on panels 26, 36 at opposite ends of panels 26, 36. Also, in one embodiment, the inverted J-shaped slots 30 may be disposed on one each of each of the panels 26, 36 substantially as shown in FIGS. 2 and 3. In each panel 26 and 36, the inverted J-shaped slots 30 may communicate with each other and form one continuous slot 32. In alternate embodiments, slots 30 may be C-shaped, I-shaped, U-shaped, V-shaped or any other slot shape that will provide for proper operation of table 10. In yet other alternate embodiments, slots 30 may be circle-shaped. Further, one or more pivot holes 28 may be disposed on each panel 26, 36 distal the J-shaped slots 30 (see FIG. 3). As shown in FIGS. 2, 3 and 5, adjuster panel height adjuster holes 33, 34 may align with side panel height adjuster holes 54, 55 respectively. Fasteners 56, i.e. one or more bolts and nuts, may securely mount the adjuster panels 36, 46 to the side panels 46, 58 respectively by placing the fasteners 56 through the corresponding height adjuster holes 33 and 54 and height adjuster holes 34 and 55, as shown in FIGS. 3–5. The viewing height of the monitor with respect to the top 20 may be adjusted by mounting the adjuster panels 26, 36 to different height adjuster holes 54, 55. The adjuster panels 26, 36 may be constructed of metal, plastic, wood or any other type of material that will provide for proper operation of the table 10.

As shown in FIGS. 3 and 5, the monitor recess top pan 68 may have adjuster slots 72, cord hole 74 and pivot holes 70. The adjuster slots 72 may be disposed on the top pan 68 so that at least a portion of the slots 72 may be aligned with the inverted J-shaped slots 30. In one embodiment, the pivot holes 70 may be disposed on the top pan 68 distal the adjuster slots substantially as shown in FIG. 3. The pivot holes 70 may be disposed on the top pan 68 so that the holes 70 align with adjuster panel pivot holes 28 substantially as shown in FIG. 3. Fasteners, i.e. bolts and nuts, may rotatably connect the top pan 68 at pivot holes 70 to the adjuster panels 26 and 36 at the adjuster panel pivot holes 28 (see FIG. 3). A pad 76 may be provided between the computer monitor 12 and the top pan 68. The pad 76 may be constructed of rubber or any other material that will prevent the computer monitor 12 from sliding when the monitor 12 is angle adjusted with respect to the top 20. In alternate embodiments, the monitor recess top pan 68 may also contain a bin 75 to hold excess cable, wire or cord 15. The monitor recess top pan 68 may accept monitors 12 of a wide variety of dimensions and weights. The monitor recess top pan 68 may be constructed of metal, plastic, wood or any other type of material that will provide for proper operation of the table 10 and provide support for the monitor 12.

In one embodiment, the rod adjuster assembly 77 may comprise one or more knobs 78, a rod 80 having threads 81 at each end of the rod 80, one or more spacers 82 and one or more washers 84. As shown in FIGS. 2, 3 and 5, rod 80 may fit into and movably interface with the plurality of inverted J-shaped slots 30 and monitor recess top pan adjuster slots 72. The inverted J-shaped slots 30 allow the rod 80 to drop and lock (or raise and lock) into the user selected slot bottom 31 and provide for monitor recess top pan 68 angle adjustments which may, for example, be in the amount of 5 degree increments with respect to the top 20. Also, the monitor recess top pan 68 angle adjustment may be in any increments that will provide for proper operation of the table 10 and monitor 12. Further, the slots 30 may be designed so that the user can pull up (or lower) the rod 80 to the desired slot 31 position without the rod 80 locking into place until the user allows the rod 80 to rest in the selected slot bottom 31. The slot bottoms 31 also act as a safety mechanism by preventing the rod 80 from slipping out of slot bottoms 31 and falling into the next slot bottom 31 position. As shown in FIG. 5, in an alternate embodiment, one or more spacers 82 may be provided to fit over each end of the rod 80. The spacers 82 may be constructed to fit inside the inverted J-slots 30 and slots 22 so that the rod 80 does not come into contact with the adjuster panels 36, 46 or monitor recess top pan 68. The spacers 82 may be constructed of plastic or any other type of material that will provide for proper operation of table 10. Further, the knobs 78 may attach to the rod 80 at each end having threads 81 or some other type of fastener capable of holding knobs 78 to rod 80, for example a cotter pin. Washers 84 may be provided in place on the rod 80 located proximate the knob 78 and adjuster panels 26, 36.

In an alternate embodiment, fasteners, such as a nut and bolt for example, may replace the rod 80. The fasteners would be used to hold the top pan slots 72 in place to the adjuster panels slot 30. This embodiment may be used in a school environment to prevent students or children from frequently moving or playing with the recess assembly 24.

As shown in FIGS. 3, 4 and 5, the support base assembly 97 may comprise leg channels 98, foot channels 104, toe kicks 106 and glides 108. The base assembly 97 may be constructed of 14 and 18 gauge steel or any other material that will provide for proper operation of the recessed monitor table 10. Leg channels 98 may mount to top 20 substantially as shown in FIG. 3. In alternate embodiments, recessed monitor table 10 may have two or more legs 98 that mount to top 20. In yet alternate embodiments, one or more metal channels may mount horizontally to the underside of top 20 and one or more legs 98 may mount to the metal channels. In yet other alternate embodiments, the leg channels 98 may have an internal channel 99 for wires or cords to travel vertically inside the channels 98. Foot channels 104 may mount substantially perpendicularly to legs 98 as shown in FIG. 3. Rotatably attached to the bottom of each foot channel 104, there may be one or more glides 108 that allow the table 10 to be leveled. It is noted that the recess assembly 24 may be attached to virtually any table configuration that is able to accept and allow for proper operation of the recess assembly 24 and is capable of physically supporting the combined weight of the recess assembly 24 and any additional computer components.

In alternate embodiments, support base assembly 97 may further have a modesty panel 118. The modesty panel 118 may connect to the base assembly 97 as shown in FIGS. 1 and 5. Further, in alternate embodiments, the panel 118 may be provided with a trough 124 which may be 3" tall by 1" deep. The trough 124 may hold wires or cords 15 in a substantially horizontal position. The modesty panel 118 may be made of any material that will provide for proper operation of table 10, such as for example steel or plastic.

In yet another alternate embodiment, a CPU holder 156 may be provided and may mount to the under side of top 20 as shown in FIG. 1. The CPU holder 156 may be expandable to support different sized CPUs. Further, the CPU holder 156 may be made of virtually any material that will provide for proper operation of table 10, such as for example steel or plastic.

As shown in FIG. 5, in yet other alternate embodiments, recessed monitor table 10 may comprise a power assembly 132. Power assembly 132 may comprise a cover 134, a data channel 136, a power channel 137, end caps 138 and electrical receptacles 142. The power assembly 132 may provide hard-wire or soft-wire power and data transfer to the table 10. Power assembly 132 may be adapted to mount to the modesty panel 118 and allow quick access to power at electrical receptacles 142 without opening the cover 134. Further, power assembly 132 may provide a separate channel 136 for data wires to separate the data wires from the power wires to prevent interference. Power assembly 132 may be designed to satisfy category 5 requirements and may be constructed of any material capable of providing for proper operation of table 10. In alternate embodiments, connectors may be provided to join power assemblies 132 between adjoining tables 10. Additionally, an eight-wire, four-circuit hard-wire system may run directly from the wall or floor through the power assembly 132 to deliver power to all the tables 10. End caps 140 may be mounted to each end of the power assembly 132 that is not joined to an adjacent power assembly 132.

As best shown in FIGS. 2 and 3, in one embodiment of the recessed monitor table 10, a computer monitor back support 90 may be provided. The back support 90 may comprise a curved wall 91 having one or more arcs 92, a rounded end 94 and a lower back end 95. The support 90 may be mounted to the top 20 substantially as shown in FIG. 3 or the support 90 may be mounted to the top 20 in any manner that will secure the support 90 to the table 10. The arcs 92 may provide for the support 90 to experience increased strength and elasticity. Also, as a result of including one or more arcs 92, the support 90 may be constructed of a material that is thinner than if the one or more arcs 90 were not included. The rounded end 94, for example, may be horizontally offset 4 inches and vertically offset 9 inches from the lower back end 95. As shown in FIG. 3 in use, when the monitor 12 is angle adjusted, the monitor 12 may rest against the support rounded end 94 and force the support 90 to bend backward. As the monitor 12 is angled backward, the back of the monitor 12 may smoothly slide along the rounded end 94. The support 90 may be constructed so that the support 90, even when the monitor 12 is in the finally recessed position, never extends past the vertical plane that is adjacent to and perpendicular to the top 20 rear portion.

In use, the rear portion of the monitor recess top pan 68 may be easily raised or lowered in 5 degree increments (or in alternate embodiments, any other degree increments) with respect to top 20. The monitor 12 does not have to be repositioned by the user on the top pan 68 for the user to adjust the angle of the rear portion of the monitor recess top pan 68. The user simply holds knob 78 and raises or lowers the rod adjuster assembly 77 which causes rod 80 to travel through slots 32 thereby allowing top pan slots 72 to follow the same path as rod 80 along slots 32. As the rear portion of top pan 68 is being raised or lowered, the front portion of top pan 68 is pivoting around pivot point 35. The user then places rod 80 in the appropriate slot bottom 31 to obtain the desired monitor 12 angle with respect to the top 20. Further, the entire monitor recess top pan 68 may be raised or lowered with respect to top 20. The user simply raises or lowers adjuster panels 26, 36 to the desired position by selecting the appropriate height adjuster holes 54, 55 in recess side panels 46, 58 and aligning the height adjuster holes 33, 34. The fasteners 56 are then inserted into the appropriate aligned adjuster holes and the top pan 68 with the monitor 12 are maintained at the appropriate height with respect to the top 20.

Specific embodiments of novel methods and apparatus for construction of novel recessed monitor tables according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed is:

1. A recessed computer monitor table that is capable of providing for height and angle adjustment of a computer monitor, said table comprising:

a top having an upper surface portion, a lower surface portion and an opening adapted to receive the computer monitor;

a support base attached to the top;

at least one recess side panel adapted to mount to the top lower surface portion;

a means for adjusting a viewing angle of the computer monitor;

at least one adjuster panel adapted to adjustably mount to the at least one recess side panel and having at least one slot that is disposed on the at least one adjuster panel and that is adapted to receive the means for adjusting; and at least one recess top pan pivotably mounted to the at least one adjuster panel at a first end and movably mounted to the at least one adjuster panel at a second end having the at least one slot wherein the means for adjusting is received by the recess top pan and the at least one adjuster panel slot at the second end to provide for the top pan to move with respect to the adjuster panel.

2. The recessed monitor table of claim 1 wherein the means for adjusting is a rod.

3. The recessed monitor table of claim 2 wherein the rod further comprises one or more knobs attached to at least one end of the rod and at least one spacer disposed on at least one end of the rod proximate to the at least one knob.

4. The recessed monitor table of claim 1 further comprising a modesty panel having a storage channel, said panel adapted to mount to the underside of the top.

5. The recessed monitor table of claim 1 further comprising a computer monitor back support attached to the table, said support comprising at least one rounded end.

6. The recessed monitor table of claim 1 further comprising means for supplying and separating power means and data transfer means to the table.

7. The recessed monitor table of claim 1 further comprising a means for holding a central processing unit, said means for holding adapted to attach to the table.

8. The recessed monitor table of claim 1 wherein the at least one adjuster panel slot after comprises at least one slot bottom disposed along the length of the at least one slot and that is adapted to securely receive the adjusting means.

9. The recessed monitor table of claim 1 wherein the at least one recess side panel further comprises at least one height adjuster hole disposed on the at least one recess side panel and adapted to removably mount to the at least one adjuster panel.

10. The recessed monitor table of claim 1 further comprising a cord bin attached to the table proximate the computer monitor.

11. A recess assembly that when mounted to a support surface having an opening adapted to receive a computer monitor can support the computer monitor and provide for height and angle adjustment of the computer monitor, said recess assembly comprising:

at least one recess side panel adapted to mount to the support surface;

a means for adjusting a viewing angle of the computer monitor;

at least one adjuster panel adapted to adjustably mount to the at least one recess side panel and having at least one slot disposed on the at least one adjuster panel adapted to receive the means for adjusting; and at least one recess top pan pivotably mounted to the at least one adjuster panel at a first end and movably mounted to the at least one adjuster panel at a second end having the at least one slot wherein the means for adjusting is received by the recess top pan and the at least one adjuster panel slot at the second end to provide for the top pan to move with respect to the adjuster panel.

12. The recess assembly of claim 11 wherein the means for adjusting is a rod.

13. The recess assembly of claim 12 wherein the rod further comprises at least one knob attached to at least one end of the rod and at least one spacer disposed on at least one end of the rod proximate to the at least one knob.

14. The recess assembly of claim 11 further comprising a computer monitor back support adapted to attach to the support surface, said back support comprising at least one rounded end.

15. The recess assembly of claim 11 wherein the at least one adjuster panel slot further comprises at least one slot bottom disposed along the length of the at least one slot and the at least one slot bottom is adapted to securely receive the adjusting means.

16. The recess assembly of claim 11 wherein the at least one recess side panel further comprises at least one height adjuster hole disposed on at least one recess side panel and the at least one height adjuster hole is adapted to removably mount to the at least one adjuster panel.

17. The recess assembly of claim 11 further comprising a cord bin attached to the support proximate the computer monitor.

18. A recess assembly that when mounted to a support surface having an opening adapted to receive a computer monitor can support the computer monitor and provide for height and angle adjustment of the computer monitor, said recess assembly comprising:

at least one or more recess side panels adapted to mount to the support surface;

a rod;

at least one adjuster panel adapted to adjustably mount to the at least one recess side panel and having at least one slot disposed on the at least one adjuster panel adapted to receive the rod; and at least one recess top pan pivotably mounted to the at least one adjuster panel at a first end and movably mounted to the at least one adjuster panel at a second end having the at least one slot wherein the rod is received by the recess top pan and the at least one adjuster panel slot at the second end to provide for the top pan to move with respect to the adjuster panel.

19. The recess assembly of claim 18 wherein the at least one recess side panel further comprising at least one height adjuster hole disposed on at least one recess side panel and adapted to removably mount to the at least one adjuster panel.

20. The recess assembly of claim 18 wherein the at least one adjuster panel slot further comprises at least one slot bottom disposed along the length of the at least one slot and the at least one slot bottom is adapted to securely receive the rod.

* * * * *

UNITED STATES PATENT AND TRADEMARK OFFICE

CERTIFICATE OF CORRECTION

PATENT NO. : 6,170,406 B1
DATED : January 9, 2001
INVENTOR(S) : Klein et al.

It is certified that error appears in the above-identified patent and that said Letters Patent is hereby corrected as shown below:

Claim 8, column 7,
Line 25, delete "after" after "slot".

Signed and Sealed this

Twenty-third Day of October, 2001

*Attest:*

Nicholas P. Godici

NICHOLAS P. GODICI
*Acting Director of the United States Patent and Trademark Office*

*Attesting Officer*